US006202886B1

(12) United States Patent
Schneider et al.

(10) Patent No.: US 6,202,886 B1
(45) **Date of Patent: *Mar. 20, 2001**

(54) CONCENTRATE CONTAINER

(75) Inventors: Larry Lee Schneider, Wadsworth, IL (US); Maynard Miller, Prince George (CA)

(73) Assignee: Lomak Bulk Carriers Corp., Prince George (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/998,411

(22) Filed: Dec. 24, 1997

(51) Int. Cl.[7] ..... B65D 25/14
(52) U.S. Cl. ..... 220/645; 220/675; 206/386
(58) Field of Search ..... 220/675, 645, 220/674, 669; 206/386

(56) References Cited

U.S. PATENT DOCUMENTS

| | | | | |
|---|---|---|---|---|
| 2,859,557 | * | 11/1958 | Lattuca | 220/675 |
| 3,659,741 | * | 5/1972 | Corelli | 220/675 |
| 4,197,958 | * | 4/1980 | Zeni et al. | 220/675 |
| 4,478,344 | * | 10/1984 | Rehrig | 220/675 |
| 4,657,141 | * | 4/1987 | Sorensen | 220/675 |
| 4,848,580 | * | 7/1989 | Wise | 220/675 |
| 5,183,180 | * | 2/1993 | Hawkins et al. | 220/675 |
| 5,381,901 | * | 1/1995 | Hundley | 220/675 |

OTHER PUBLICATIONS

Photograph dated Sep. 9, 1994 which illustrates prior art ore containers.

* cited by examiner

*Primary Examiner*—Joseph M. Moy
(74) *Attorney, Agent, or Firm*—John Russell Uren

(57) ABSTRACT

Container for holding concentrate. The container is made from a plastic material and has a front wall, two sidewalls and a rearwall. The frontwall is smooth within the container and assists in separating the concentrate from the container when the concentrate is dumped from the container. The rearwalls and the sidewall are stepped about their circumference to enhance the strength carrying capacities of the container. A floor area has a forklift so as to allow lifting and rotation of the container so that the concentrate may be dumped from the container over the smooth inside of the front wall.

10 Claims, 4 Drawing Sheets

CONCENTRATE CONTAINER

This invention relates to a container and, more particularly, to a container used for carrying concentrate and used in the trucking industry.

BACKGROUND OF THE INVENTION

In the trucking industry, concentrate containers have been used for many years. Typically, the containers are transported by way of flat bed trailers. The containers are generally filled at the location of the mine where the concentrate is obtained. Thereafter, they are transported to a smelter or warehouse where the containers are removed from the flat bed trailers by fork lift trucks and the containers are dumped. The containers are then returned to the mine where they are again loaded with concentrate.

Concentrate containers presently used, commonly called concentrate pots, are steel and have a round or circular configuration. Such containers, however, have several disadvantages.

First, the containers are heavy because they are steel or stainless steel. This reduces the payload that can be carried by the trailer because of loading restrictions on the highway and the like. Second, such containers have a relatively high centre of gravity because they are circular. This make transportation less safe than would be the case if the centre of gravity of the container were lower. Third, such containers have a relatively high wind resistance on the trailer because of their high profile and high centre of gravity. This increases fuel costs and loading on the tractor used to pull the trailer. Fourth, it has been found that the concentrate loaded into the container tends to bind with the steel walls of the concentrate pot. When unloading the concentrate from the pot, the concentrate may stick in the pot and increase the difficulty of the unloading operation. In order to reduce this binding between the concentrate and the steel walls of the concentrate pots, plastic inserts may be used. However, adding the plastic to the concentrate pot is an inefficient additional operation in loading the pot and the handling of the plastic inserts is also troublesome during the emptying of the concentrate pot.

SUMMARY OF THE INVENTION

According to the invention, there is provided a container for holding concentrate, said container being made from mouldable plastic and being defined by a generally rectangular configuration, said container comprising a front wall, sidewalls adjoining said front wall and a rearwall adjoining said sidewalls, a forklift entry area in the lower area of said container, said front wall being generally smooth over its inside area, said sidewalls and said rearwall being reinforced for strengthening purposes, said forklift entryway in said lower area of said container running generally parallel to said front wall.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
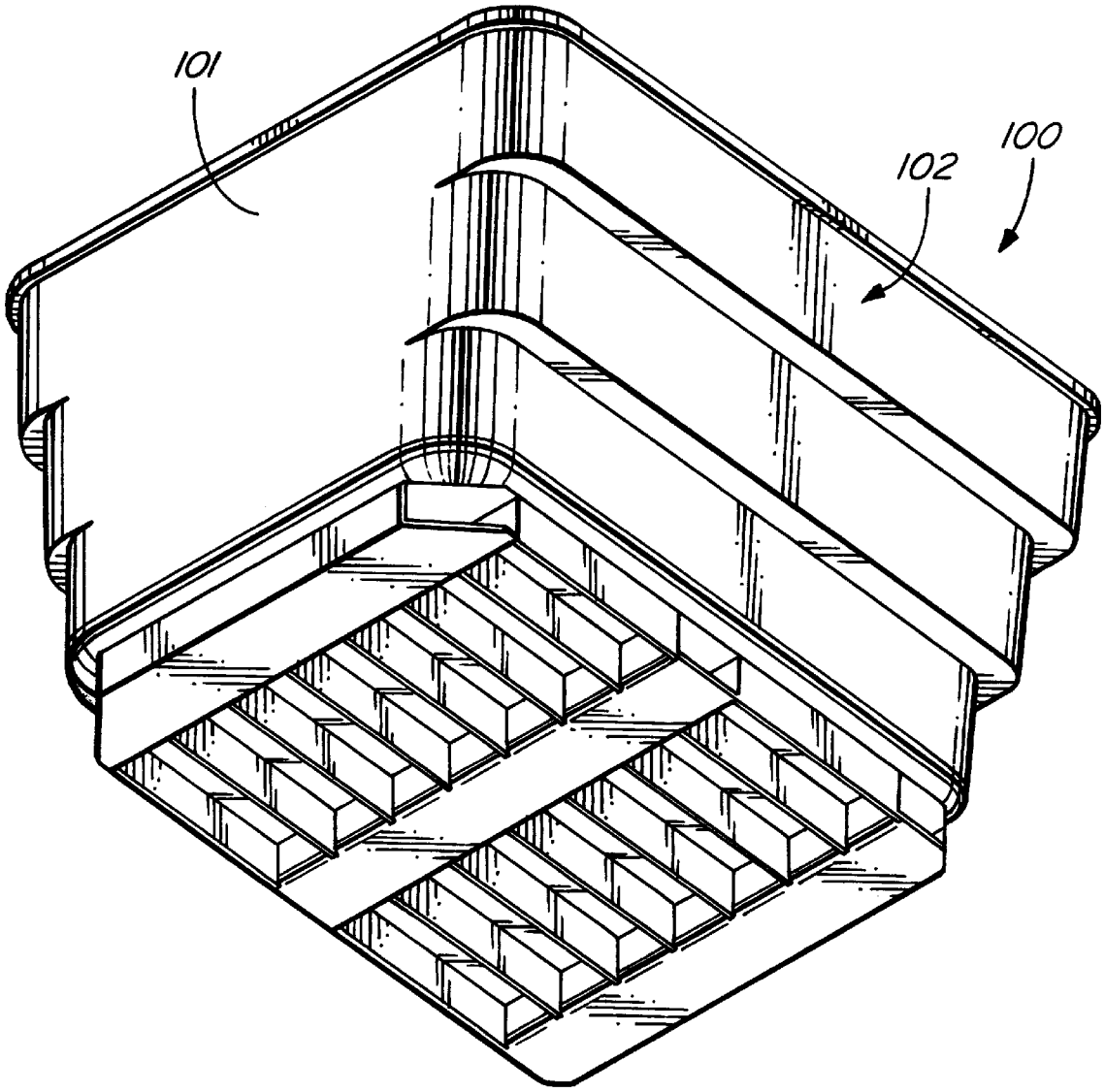
FIG. 1 is a bottom diagrammatic isometric view of the concentrate container according to the present invention.
Figure 2:
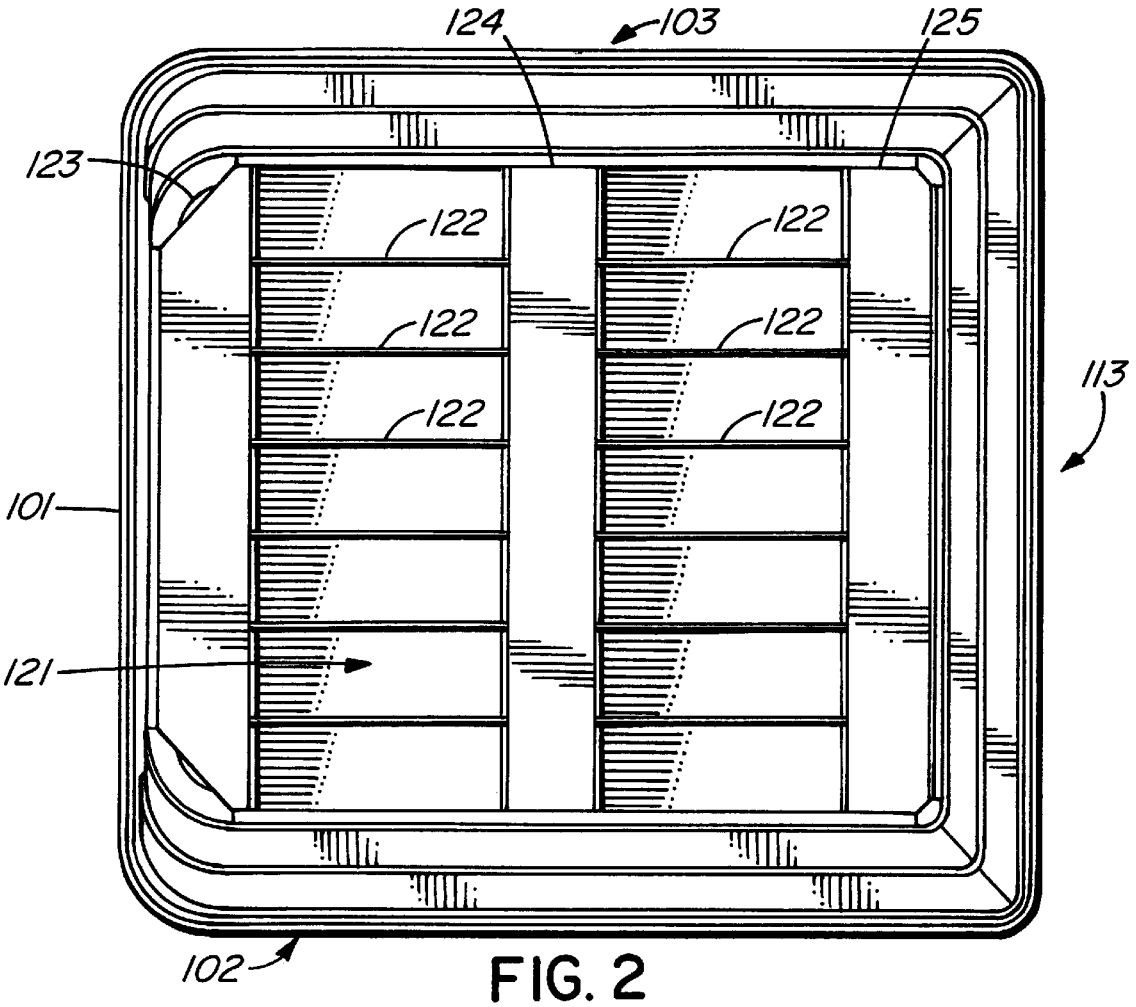
FIG. 2 is a bottom view of the concentrate container of FIG. 1.
Figure 3:
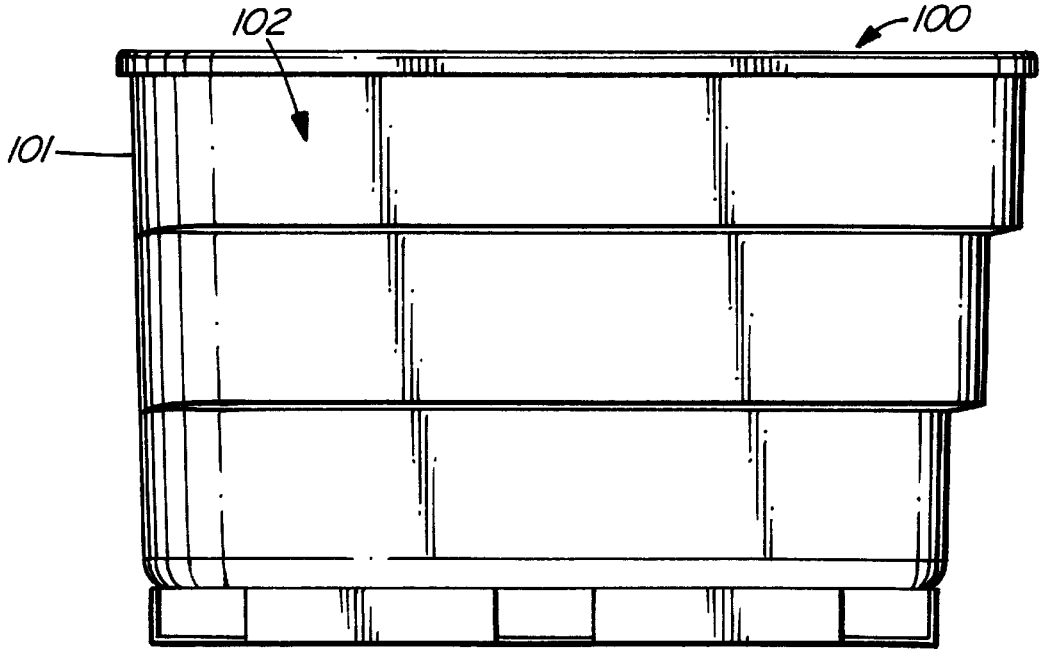
FIG. 3 is side view of the concentrate container of FIG. 1.
Figure 4:
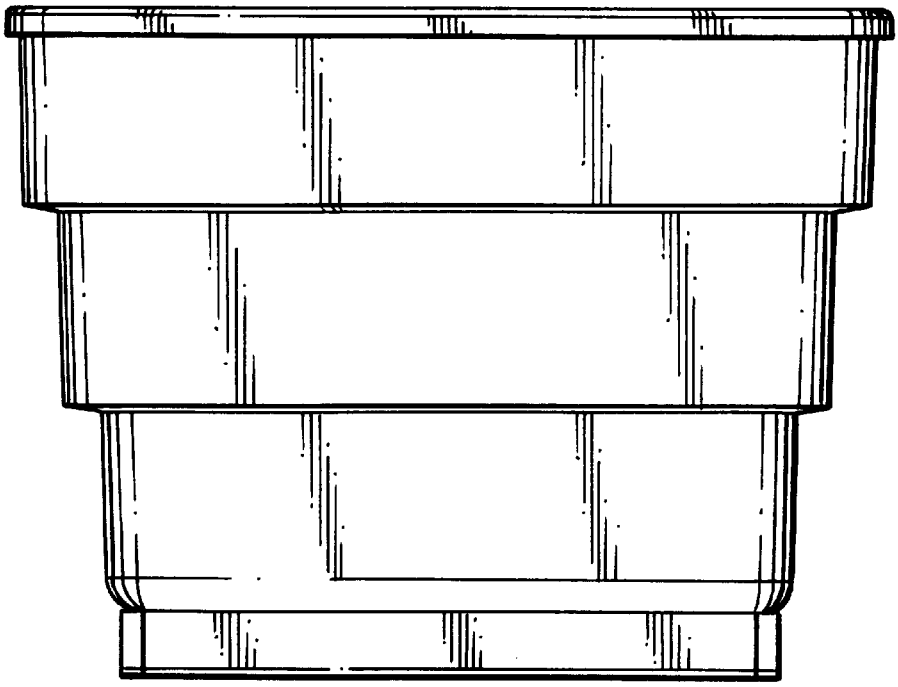
FIG. 4 is rear view of the concentrate container of FIG. 1.
Figure 5:
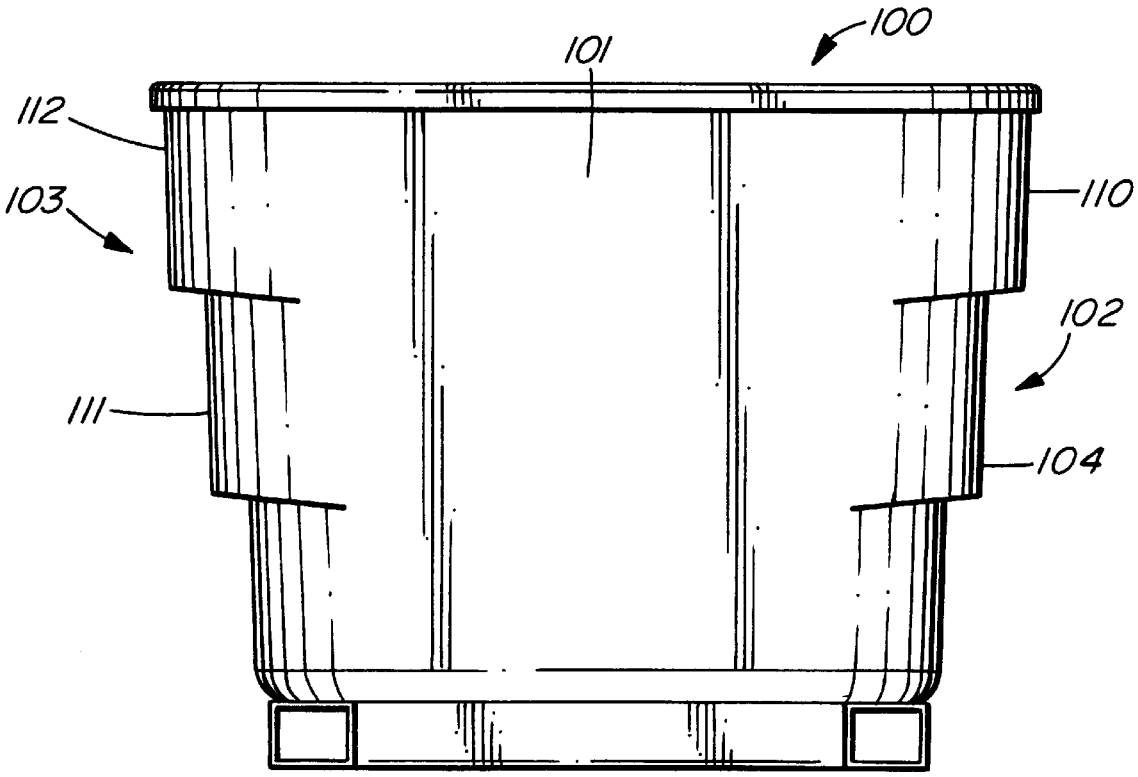
FIG. 5 is a front view of the concentrate container of FIG. 1.

With reference now to the drawings, a concentrate container according to the invention is generally illustrated at 100 in FIG. 1. The container 100 is made from a molded plastic material, conveniently crosslinked polyethylene plastic. It includes a first pouring wall or front wall 101 which has a smooth inside wall within the container 100.

Front wall 101 adjoins two (2) sidewalls shown generally at 102, 103, respectively. Each of the sidewalls 102, 103 is reinforced by way of a stepped configuration; that is, sidewalls 102, 103 have two (2) steps 104, 110 which are formed as illustrated and sidewall 103 has two (2) steps 111, 112 which are formed as illustrated. The steps 104, 110, 111, 112 are formed for the purposes of reinforcing the strength of the sidewalls 102, 103.

A rearwall 113 joins with the two sidewalls 102, 103. Rearwall 113 is likewise stepped for strengthening purposes with two (2) steps 114, 120. Each of the steps 104, 110, 111, 112, 114, 120 is approximately eighteen (18) inches deep with each of the sidewalls 102, 103 having a top dimension of approximately 115 inches with the rearwall having a top dimension of approximately 97". The top dimension of the front wall 101 is likewise approximately 97", all as illustrated.

The container 100 has a floor generally illustrated at 121. The plurality of ribs 122 are formed beneath the floor 121 which are also used for strengthening purposes. Forklift entryways 123, 124, 125 are formed beneath the floor 121 and besides and between the ribs 122. Forklift entryways 123, 124, 125 are formed to be parallel with frontwall 101 for the purposes as described in greater detail hereafter.

An upper lip 131 is also formed in the container 100. Lip 131 is intended for strengthening purposes and forms the upper circumference of the container 100.

OPERATION

Figure 6:
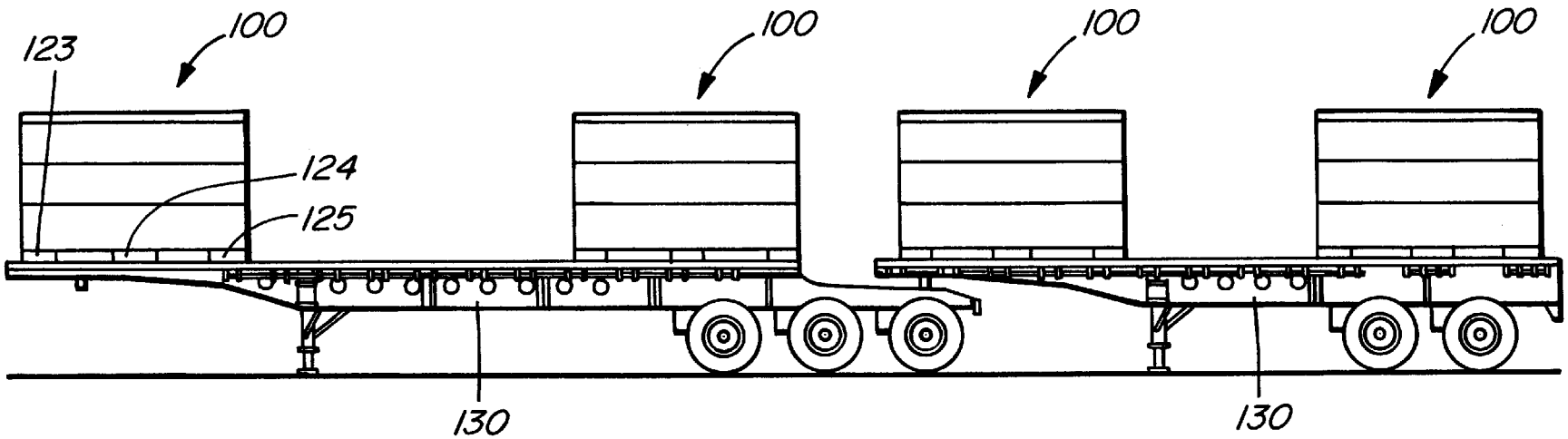
FIG. 6 is a diagrammatic view of the concentrate container according to the invention in position on a flatbed trailer.

In operation and with reference to FIG. 6, it will be assumed that the concentrate container 100 according to the invention has previously been loaded and secured to the flatbed trailer 130 as illustrated. It will also be assumed that the trailer 130 has been transported to the source of the mineral concentrate, conveniently lead or zinc although all mineral concentrates are used and that each of the concentrate containers 100 has been loaded with concentrate and that the containers 100 with their full loads are now ready for unloading.

A forklift (not illustrated) will insert its forks into the forklift entranceways 123, 124, 125 and raise the forks thereby to remove the container 100 from the trailer 130. The container 100 will be transported by the forklift to the concentrate unloading area where the container 100 will be rotated with the frontwall 101 being lowered and the rearwall 113 being raised. The frontwall 101 will become slightly bowed due to the weight of the concentrate acting thereon and any seal or binding between the concentrate and the front wall 101 will be broken by the bowing. When the level of concentrate overflows the top of front wall 101, the concentrate will slide down the inside of front wall 101 and leave the container 100. The container 100 will continue to be rotated until all of the concentrate leaves the container 100 down the smooth inside of front wall 101.

The container 100 is intended to a single piece of crosslinked polyethylene plastic material. However, since the force on the floor 121 and on the forklift entryways 123, 124, 125 is considerable, particularly during the unloading operation, it is contemplated that the forklift entryways 123, 124, 125 could be made of a metal material such as steel, stainless steel or the like. Such a modification would not change the advantages of the invention although the payload would be somewhat reduced by the increased weight of the metal forklift entryways 123, 124, 125. In this event, the floor 121 of the container 100 would be connected directly to the steel undercarriage which makes up the forklift entryway area by bolts, removable pins or the like.

While a specific embodiment of the invention has been described, such description should be taken as being illustrative of the invention only and not as limiting in scope. Many modifications will readily occur to those skilled in the art to which the invention relates and the invention should be construed only in accordance with the accompanying claims.

PARTS LIST

100. concentrate container
101. frontwall
102. sidewall
103. sidewall
104. step
105.
106.
107.
109.
110. step
110. step
111. step
112. step
113. rearwall
114. step
115.
116
117.
118.
119.
120. step
121. floor
122. ribs
123. fork lift entranceway
124. fork lift entranceway
125. fork lift entranceway
130. flatbed trailer
131. lip

We claim:

1. A container for holding concentrate, said container being made from moldable plastic and being defined by a generally rectangular configuration, said container comprising a front wall, sidewalls adjoining said front wall and a rearwall adjoining said sidewalls, a forklift entryway in the lower area of said container, said front wall being generally smooth over its inside area, said sidewalls and said rearwall being reinforced for strengthening purposes by a stepped configuration molded into said container and extending around said sidewalls and said rearwall, said forklift entryway having a longitudinal axis, said longitudinal axis being generally parallel to said front wall and having a configuration which will allow rotation of said container and disperse said concentrate from said front wall, said front wall being flexible to allow breaking of binding action between said front wall and said concentrate.

2. Container as in claim 1 wherein said stepped configuration comprises steps in said rearwall and said sidewalls, said steps numbering two(2).

3. Container as in claim 2 wherein said steps extend about the circumference of said rearwall and said sidewalls.

4. Container as in claim 3 wherein said forklift entryway numbers two entryways and further comprising reinforcements between said two entryways.

5. Container as in claim 4 wherein said reinforcements between said two entryways are ribbed connections.

6. Container as in claim 5 and further comprising a lip molded about the circumference of said container in the upper area of said frontwall, said sidewalls and said rearwall.

7. Container as in claim 6 wherein said container and said forklift entryway are molded from a single plastic material.

8. Container as in claim 7 wherein said plastic material is crosslinked polyethylene plastic.

9. Container as in claim 6 wherein said container is molded from a plastic material and said forklift entryway is made from a metallic material.

10. Container as in claim 9 wherein said plastic material is crosslinked polyethylene and said metallic material is steel.

* * * * *